US011319755B2

(12) United States Patent
Keskiniva

(10) Patent No.: US 11,319,755 B2
(45) Date of Patent: May 3, 2022

(54) ARRANGEMENT AND METHOD FOR INSTALLING CASING

(71) Applicant: Mincon Nordic Oy, Ylöjärvi (FI)

(72) Inventor: Markku Keskiniva, Lempäälä (FI)

(73) Assignee: Mincon Nordic Oy, Ylöjärvi (FI)

( * ) Notice: Subject to any disclaimer, the term of this patent is extended or adjusted under 35 U.S.C. 154(b) by 0 days.

(21) Appl. No.: 16/960,501

(22) PCT Filed: Jan. 21, 2019

(86) PCT No.: PCT/FI2019/050043
§ 371 (c)(1),
(2) Date: Jul. 7, 2020

(87) PCT Pub. No.: WO2019/145602
PCT Pub. Date: Aug. 1, 2019

(65) Prior Publication Data

US 2021/0062586 A1 Mar. 4, 2021

(30) Foreign Application Priority Data

Jan. 23, 2018 (FI) ..... 20185061

(51) Int. Cl.
*E21B 1/30* (2006.01)
*E21B 4/14* (2006.01)
(Continued)

(52) U.S. Cl.
CPC ..... *E21B 7/20* (2013.01); *E21B 4/14* (2013.01); *E21B 6/04* (2013.01)

(58) Field of Classification Search
CPC ... E21B 1/30; E21B 7/23; E21B 7/208; E21B 7/203; E21B 7/20; E21B 4/14; E21B 1/32
See application file for complete search history.

(56) References Cited

U.S. PATENT DOCUMENTS 1,868,400 A * 7/1932 Stover ..... E21B 21/12 175/69
1,897,121 A * 2/1933 Narris ..... E21B 4/14 175/94

(Continued)

FOREIGN PATENT DOCUMENTS

CA 3 089 247 A1 8/2019
CN 111727297 A 9/2020

(Continued)

OTHER PUBLICATIONS

First Office Action received for Canadian Patent Application Serial No. 3,089,247 dated Aug. 24, 2021, 3 pages.

(Continued)

*Primary Examiner* — Kipp C Wallace
(74) *Attorney, Agent, or Firm* — FisherBroyles, LLP

(57) ABSTRACT

An arrangement and a method for installing a casing in a borehole are described. The arrangement includes a casing, a boring pipe, which is adapted within the casing, and the boring pipe includes flow channels for compressed air and a flushing medium. The flushing medium flow channel is arranged to lead the flushing medium to the bottom of the borehole. The arrangement also includes a percussion hammer, which includes a compressed air operated percussion piston adapted in a cylinder of the percussion hammer, as well as hole drilling means for drilling a hole for the casing. The flushing medium flow channel is adapted to bypass the percussion piston or which flushing medium flow channel is adapted to pass through the percussion piston, and in which arrangement the drilling means additionally includes splines transmitting a rotating motion and adapted to conduct the compressed air that used the percussion piston through the splines.

23 Claims, 7 Drawing Sheets

(51) Int. Cl.
*E21B 7/20* (2006.01)
*E21B 6/04* (2006.01)

(56) References Cited

U.S. PATENT DOCUMENTS

| | | | | | |
|---|---|---|---|---|---|
| 1,993,740 | A | | 3/1935 | Harris | |
| 3,444,937 | A | * | 5/1969 | Manning | E21B 4/14 175/92 |
| 3,640,350 | A | * | 2/1972 | Stenuick | E21B 4/14 173/61 |
| 4,509,606 | A | | 4/1985 | Willis | |
| 4,583,601 | A | * | 4/1986 | Techy | E21B 4/14 173/209 |
| 4,694,911 | A | * | 9/1987 | Kennedy | E21B 4/14 173/62 |
| 5,143,162 | A | * | 9/1992 | Lyon | E21B 4/14 175/100 |
| 5,240,083 | A | * | 8/1993 | Lyon | E21B 4/14 175/324 |
| 10,808,476 | B2 | * | 10/2020 | Purcell | E21B 17/0426 |
| 2015/0330151 | A1 | * | 11/2015 | Egerstrom | E21B 7/208 175/305 |
| 2016/0108686 | A1 | | 4/2016 | Speer et al. | |
| 2018/0274299 | A1 | * | 9/2018 | Strange | E21B 7/067 |

FOREIGN PATENT DOCUMENTS

| | | | | | |
|---|---|---|---|---|---|
| DE | 39 05 106 | A1 | | 8/1990 | |
| EP | 3 743 590 | A1 | | 12/2020 | |
| FI | 111408 | B | | 7/2003 | |
| FI | 20185061 | A1 | | 7/2019 | |
| FR | 2126118 | A | * | 2/1971 | E21B 1/00 |
| FR | 2.126.118 | A1 | | 10/1972 | |
| GB | 946678 | A | | 1/1964 | |
| JP | S55-14237 | B1 | | 4/1980 | |
| JP | H8-312278 | A | | 11/1996 | |
| JP | H10-88952 | A | | 4/1998 | |
| JP | 2000-104475 | A | | 4/2000 | |
| JP | 2009-501856 | A | | 1/2009 | |
| JP | 2013-28936 | A | | 2/2013 | |
| JP | 2021-511459 | A | | 5/2021 | |
| KR | 10-2020-0130680 | A | | 11/2020 | |
| SE | 390653 | B | | 1/1977 | |
| WO | 00/26576 | A1 | | 5/2000 | |
| WO | 2007/010513 | A1 | | 1/2007 | |
| WO | 2019/145602 | A1 | | 8/2019 | |

OTHER PUBLICATIONS

Extended European Search Report received for EP Patent Application Serial No. 19743864.1 dated Sep. 8, 2021, 9 pages.

Notice of Reasons for Refusal received for EP Patent Application Serial No. 2020-560601 dated Sep. 7, 2021, 6 pages. (Including English Translation).

International Preliminary Report on Patentability received for PCT Application Serial No. PCT/FI2019/050043 dated Aug. 6, 2020, 11 pages.

International Search Report and Written Opinion received for PCT Application No. PCT/FI2019/050043, dated Apr. 15, 2019, 14 pages.

Finnish Search Report for Finnish Application No. 20185061, dated Sep. 13, 2018, 1 page.

* cited by examiner

ARRANGEMENT AND METHOD FOR INSTALLING CASING

CROSS-REFERENCE TO RELATED APPLICATIONS

This application is a National Stage application of International Application No. PCT/FI2019/050043, filed Jan. 21, 2019, which claims benefit to Finnish Application No. 20185061, filed Jan. 23, 2018, which are incorporated by reference herein in their entireties.

BACKGROUND

The invention relates to an arrangement for installing a casing.

The invention further relates to a method for installing a casing.

SUMMARY

An effective way to install a casing or pole to hard ground when the casing is driven partly into a rock, for example, is percussive drilling. In such a case, a casing has inside it boring pipes, and at an end of the boring pipe, a percussion hammer, such as a down-the-hole-hammer type, or DTH hammer. A boring pipe has a centre opening through which compressed air required by the DTH hammer is fed to it. The boring pipe, DTH hammer, pilot crown and reamer connected to the latter are simultaneously rotated by a rotation mechanism at the top end of the boring pipe.

The boring of the hole takes place by means of the percussion function generated by the hammer, and the rotation of the boring pipe. The purpose of the reamer is to broaden the hole made by the pilot crown so big that the casing fits into the drilled hole. The casing may additionally have a so-called casing shoe by means of which the pilot crown pulls the casing with it into the drilled hole. The removal of released material takes place by means of exhaust air of the DTH hammer. Here, the exhaust air of the DTH hammer is led, by means of bores in the pilot crown, to the bottom of the hole being drilled, from where the attempt is made to lead the air flow that takes released material with it inside the casing and from the casing further to the surface of the ground.

The problem here is that typically part of the air flow will inevitably escape to the ground. Excessive escaping of air may significantly reduce the bearing strength of the surrounding ground and consequently cause danger to structures in the surroundings, such as the foundations of buildings.

It is partly possible to manage the escaping of air to the ground by the design of the pilot crown. In particular, a crown in which the blowing of flushing air to the bottom of a hole is turned parallel to the bottom of the hole before it discharges from the crown reduces the escaping of air into the ground.

Another, far more effective way is to use a separate flushing circuit where the flushing of the borehole does not takes place by means of exhaust air, but with water or another, similar flushing medium. This allows the use of the so-called RC drilling system (Reverse Circulation). The RC drilling system was originally developed for research drilling where the loose material that drilling creates is flushed up from the bottom of a hole along a centre opening of a two-layer drill pipe whereby it may be stored for later analysis.

The RC system consists of RC boring pipes and an RC hammer. The RC boring pipe typically has an outer pipe and an inner pipe, where an inner opening of the inner pipe and the space between the outer pipe and inner pipe form two separate flow channels. The operation of the actual RC hammer is identical to that of a normal DTH hammer. An RC hammer has a pipe passing through the hammer, along which exhaust air of the hammer flows through the hammer, carrying with it the released material. The percussion piston of the hammer has a relatively large centre opening for the pipe so that the pipe in question and the air flow channel, essential for the operations of the DTH hammer, fit through the percussion piston.

The RC boring system may be applied to ground boring when it is desired to prevent air from escaping to the ground.

In this case, an RC boring pipe is used to feed the operating compressed air needed by the RC hammer, and well as the flushing medium, such as water, to the RC hammer. The flushing medium is typically supplied through the inner opening of the inner pipe, and the compressed air is supplied through the space between the pipes. The exhaust air of the RC hammer is fed through the drill crown inside the casing, from where it exits to the ground surface. The flushing medium is fed through the pipe passing through the RC hammer further through the drill crown to the bottom of the hole from where it flushes the released material with it. After this, the flushing medium and released material are transferred to the ground surface along the gap between the casing and hole.

The method making use of the RC boring system is most suited to boring sites where the escaping of air to the ground is not permitted at all. The problem, however, exists that the pipe passing through the RC hammer requires a percussion hammer with a relatively large centre opening. This substantially reduces the mass of the piston and the pneumatic working surfaces on which the percussion piston is moved back and forth. In other words, the boring power generated by an RC hammer is substantially lower than that of a conventional DTH hammer.

The arrangement and method of the invention are characterized by what is disclosed in the independent claims. The other embodiments of the invention are characterised by what is disclosed in the rest of the claims.

Inventive embodiments are also disclosed in the specification and drawings of this application. The inventive content of the application may also be defined differently than in the claims presented below. The inventive content may also consist of several separate inventions, particularly if the invention is examined in the light of disclosed or implicit subtasks or from the point of view of gained advantages or groups of advantages. In such a case, some of the definitions in the claims below may be irrelevant to the separate inventive ideas. The features of the different embodiments of the invention may be applied to other embodiments within the scope of the basic inventive idea.

In accordance with an idea, the arrangement for installing a casing in a borehole comprises a casing and boring pipe which is adapted within the casing, the boring pipe comprising flow channels for compressed air and a flushing medium, the flushing medium flow channel being arranged to lead flushing medium to the bottom of the borehole, as well as a percussion hammer which comprises a compressed air operated percussion piston adapted in a cylinder of the percussion hammer, and hole drilling means for drilling a hole for the casing, the flushing medium flow channel being adapted to bypass the percussion piston.

An arrangement according to an embodiment for installing a casing in a borehole comprises a casing and boring pipe adapted within the casing, the boring pipe comprising a flow channel for compressed air. The arrangement further comprises a flow channel for a flushing medium, which is adapted within the casing and arranged to lead the flushing medium to the bottom of the bore hole, as well as a percussion hammer which comprises a compressed air operated percussion piston adapted in a cylinder of the percussion hammer, and hole drilling means for drilling a hole for the casing, the flushing medium flow channel being adapted to bypass the percussion piston, or in which arrangement the drilling means additionally comprise splines transmitting a rotating motion and adapted to conduct the compressed air that used the percussion piston through the splines, and in which arrangement the flushing medium flow channel is adapted to pass through the percussion piston.

An arrangement according to an embodiment for installing a casing in a borehole comprises a casing and boring pipe which is adapted within the casing, the boring pipe comprising a flow channel for compressed air and a flow channel for a flushing medium, which is adapted within the casing and arranged to lead the flushing medium to the bottom of the bore hole, as well as a percussion hammer which comprises a compressed air operated percussion piston adapted in a cylinder of the percussion hammer, and hole drilling means for drilling a hole for the casing, the flushing medium flow channel being adapted to bypass the percussion piston, or in which arrangement the drilling means additionally comprise splines transmitting a rotating motion and adapted to conduct the compressed air that used the percussion piston through the splines, and in which arrangement the flushing medium flow channel is adapted to pass through the percussion piston.

According to a second idea, the method for installing a casing utilises an arrangement that comprises a casing and boring pipe as well as a percussion hammer and hole drilling means, in which method the boring pipe is rotated inside the casing, the percussion hammer is used by compressed air, and the bottom of the bore hole is flushed by a flushing medium which is led past the percussion piston of the percussion hammer from the boring pipe to the hole drilling means and further to the bottom of the borehole.

According to an idea, the method for installing a casing utilises an arrangement that comprises a casing and boring pipe, a percussion hammer and means for boring a hole, in which method the boring pipe is rotated inside the casing, the percussion hammer is used by compressed air, and the bottom of the bore hole is flushed by a flushing medium which is led past the percussion piston of the percussion hammer to the hole drilling means and further to the bottom of the borehole, or the bottom of the borehole is flushed by the flushing medium that is led through the percussion piston to the hole drilling means and further to the bottom of the hole, and in which arrangement the drilling means additionally comprise splines transmitting a rotating motion, by means of which the compressed air that used the percussion piston is conducted through the splines.

In the following, some embodiments of the invention are presented in a random order.

According to an embodiment, on the outside of the cylinder of the percussion hammer there is adapted a shell which together with said cylinder wall forms a part of the flushing medium flow channel, the part bypassing the percussion piston.

According to an embodiment, the part of the flushing medium flow channel, which bypasses the percussion piston, extends circularly around the cylinder of the percussion hammer.

According to an embodiment, the shell adapted on the outside of the cylinder forms part of the outer surface of the percussion hammer.

According to an embodiment, on the outside of the cylinder of the percussion hammer there are adapted one or more pipes which form part of the flushing medium flow channel, bypassing the percussion piston.

According to an embodiment, the part of the flushing medium flow channel, which bypasses the percussion piston is by its top end connected to an adaptor of the boring pipe, having an adapter flow channel which is arranged to move the flushing medium flow channel further from the longitudinal centre axis of the arrangement.

According to an embodiment, the arrangement further comprises at least one collar which is connected to the casing or to a casing shoe fixed to the casing, where the part of the flushing medium flow channel, bypassing the percussion piston, is by its bottom end connected to at least one collar.

According to an embodiment, at least one collar in the arrangement additionally comprises at least one locking member for locking the at least one collar to the casing or casing shoe.

According to an embodiment, the at least one locking member is adapted to lock the at least one collar to the casing or casing shoe by means of a pressurised flushing medium.

According to an embodiment, the at least one locking part comprises a pressure line which is adapted to lock the at least one collar to the casing or casing shoe.

According to an embodiment, the percussion hammer comprises a bottom member which has at least one flushing medium flow channel of the bottom member, which is adapted in flow connection to the part of the flushing medium flow channel, bypassing the percussion piston, and in which the hole drilling means comprise at least one flushing medium flow channel of the drilling means, which is adapted in flow connection to the flushing medium flow channel of the bottom member and to lead the flushing medium to the bottom of the borehole.

According to an embodiment, the flow channel of the bottom member comprises a circular flow groove which is adapted on the inner surface of the bottom member and which circulates in the plane of said inner surface, which is at least substantially perpendicular to the longitudinal centre axis of the arrangement.

According to an embodiment, the width of the circular flow groove, that is, the dimension in the direction of the longitudinal centre axis of the arrangement, is dimensioned wide enough so that the flushing medium flow channel stays open for the entire duration of the boring work regardless of the movement of the drilling means.

According to an embodiment, there are seals adapted on both sides of the circular flow groove.

According to an embodiment, the hole drilling means comprise at least one flushing medium flow channel of the drilling means, which is adapted to lead the flushing medium from the flushing medium flow channel to the bottom of the borehole, and in which arrangement the flushing medium flow channel is adapted to pass through the percussion piston.

According to an embodiment, the compressed air that used the percussion piston is removed by an exhaust air channel that comprises a centre opening in the hole drilling means, which is in flow connection to the cylinder of the percussion hammer, and at least one air channel passing radially through the bottom member of the percussion hammer, the air channel being in flow connection to the space between the percussion hammer and casing.

According to an embodiment, the drilling means additionally comprise splines transmitting a rotating movement and adapted to conduct the compressed air that used the percussion piston through the splines.

According to an embodiment, the compressed air that used the percussion piston is removed by an exhaust air channel which comprises at least one side exhaust air channel led past the hole drilling means, which is in flow connection to the cylinder of the percussion hammer, and an air flow channel which is in flow connection to said at least one exhaust air channel, and at least one air channel passing radially through the bottom member of the percussion hammer, the air channel being in flow connection to the space between the percussion hammer and casing.

According to an embodiment, the side exhaust air channel is formed among the splines.

According to an embodiment, the circular flow groove which is adapted on the inner surface of the bottom member, facing the drilling means, and circulates in the plane of a part of said inner surface, which is at least substantially perpendicular to the longitudinal centre axis of the arrangement.

According to an embodiment, the percussion hammer is a DTH hammer.

BRIEF DESCRIPTION OF THE DRAWINGS

The invention is described in more detail in the accompanying drawings, in which.

For the sake of clarity, the figures show the invention in a simplified manner. Similar parts are indicated in the figures by the same reference numbers.

DETAILED DESCRIPTION

Figure 1:
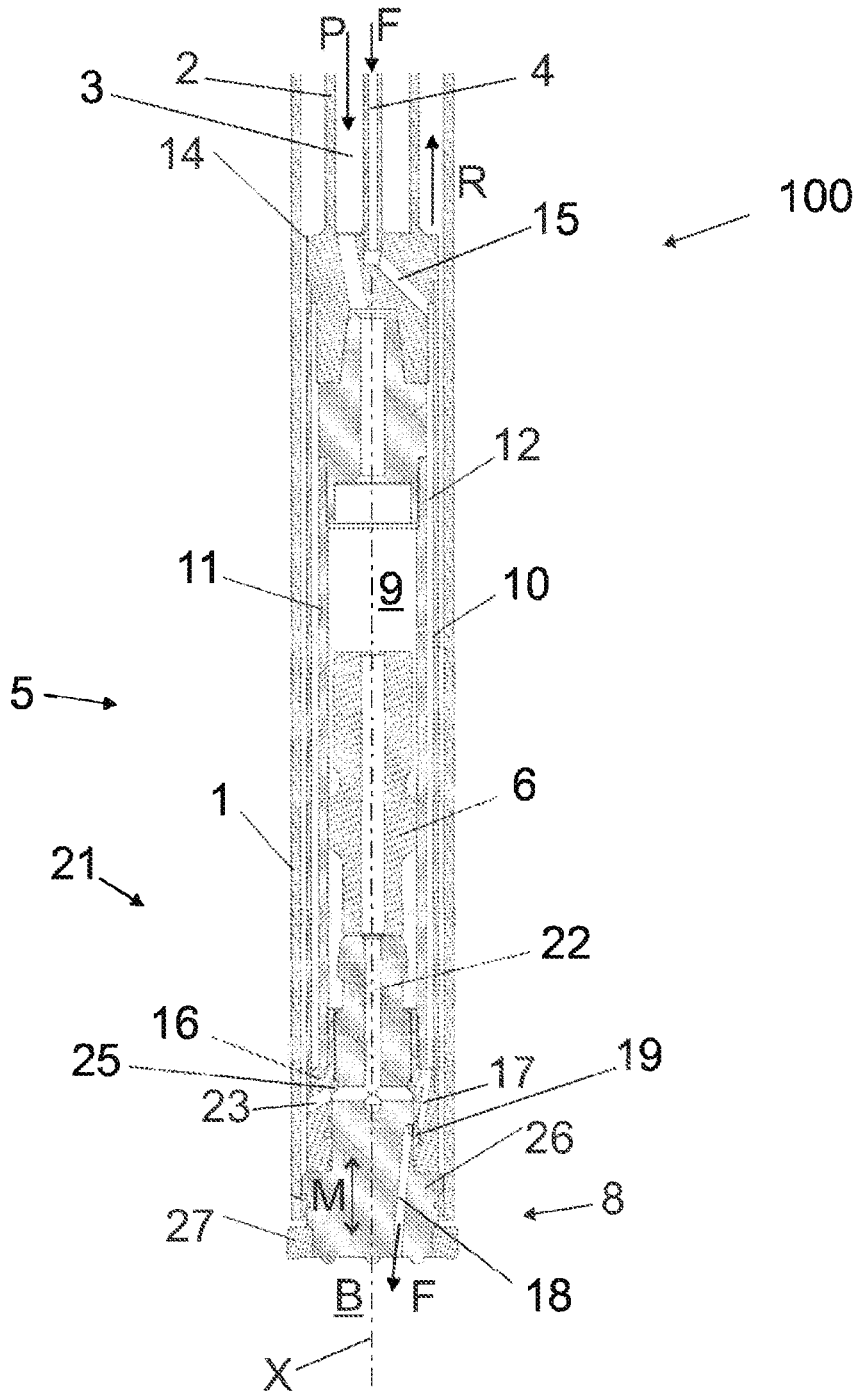
FIG. 1 is a schematic sectional side view of an arrangement for installing a casing.

FIG. 1 is a schematic sectional side view of an arrangement for installing a casing.

The arrangement 100 comprises a casing 1, which is a tubular piece installed in the ground, typically permanently. At the installation stage of the casing 1, boring pipe 2 has been adapted inside it to be rotated inside the casing. The arrangement 100 further comprises a percussion hammer 5 which is operated by compressed air. For this purpose, the arrangement 100 features a flow channel for compressed air 3. The bottom X of the borehole is flushed by a flushing medium which is fed to the bottom B of the borehole through the flow channel 4.

The flushing medium may be water, a mixture containing water, such as boring sludge, or another suitable substance in a flowing form.

The percussion hammer 5 shown in FIG. 5 is a compressed air operated DTH hammer (down-the-hole-hammer). Obviously, the percussion hammer 5 may, as concerns it basic idea, be a hammer other than a DTH hammer.

Note, however, that the drawings only show the hammer parts that are essential from the viewpoint of the invention. The figures show an embodiment of the DTH hammer, which does not utilise a foot valve installed to the top end of a pilot crown. The arrangement according to the invention is naturally also suitable for embodiments provided with a foot valve.

The percussion hammer 5 comprise a compressed air operated percussion hammer 6 which is adapted to the cylinder 9 of the percussion hammer movably back and forth.

The arrangement 100 further comprises hole drilling means 8 for boring a hole into the ground for the casing 1. In the embodiment shown in the figure, the drilling means 8 comprise a pilot crown 26 and reamer 27. The drilling means 8 may be formed in another manner: in an embodiment, the drilling means 8 comprise a so-called wing reamer, in another words, a drill crown with wings that open.

In the arrangement, the flushing medium flow channel 4 is adapted to bypass the percussion piston 6 of the percussion hammer 5. The advantage of this arrangement is that the flushing of the bottom B of the borehole may be effectively implemented with the use of a separate flushing circuit, while the drilling power of the percussion piston is high due to the large mass and large pneumatic working area of the percussion piston. According to an idea, it may be noted that the advantages of a DTH hammer and RC hammer have been combined.

In the embodiment shown in FIG. 1, the flushing medium flow channel 4 comprises a part 12 which bypasses the percussion piston 6 and which extends in a circular manner around the cylinder 9 of the percussion hammer. Said part 12 of the flow channel is formed by adapting a tubular shell 10 around the cylinder 9. The shell may be formed of steel or similar. In accordance with FIG. 1, the shell 10 adapted outside the cylinder 9 may form part of the outer surface of the percussion hammer 5, but this is not compulsory, however.

The part 12 bypassing the flushing medium flow channel of the percussion piston connects at its top end to an adaptor 14 of the boring pipe, which connects the boring pipe 2 to the percussion hammer 5. The boring pipe adaptor 14 has an adaptor flow channel 15 which is arranged to shift the flushing medium flow channel 4 further from the longitudinal centre axis X of the arrangement, whereby the part 12 of the flow channel may be advantageously connected, in the flow technical sense, to the flushing medium channel in the boring pipe.

The percussion hammer 5 comprises a bottom member 16 which has at least one flushing medium flow channel 17 of the bottom member, which is adapted in flow connection to the part 12 of the flow channel flushing medium, bypassing the percussion piston. In an embodiment, the quantity of flushing medium flow channels 17 is three. The task of the bottom member flushing medium flow channel 17 is to lead the flushing medium from the structures of the percussion hammer 5 to the drilling means 8.

The drilling means 8 of a hole comprise at least one drilling means flushing medium flow channel 18 which leads the flushing medium to the bottom B of the borehole. In an embodiment, the quantity of the drilling means flushing medium flow channels 18 is three.

In the embodiment of FIG. 1, the flow channel 18 opens roughly parallel to the centre axis X to the bottom B of the borehole. This way, efficient flushing is accomplished directly against the bottom B of the borehole. In some other embodiment, the flow channel 18 opens at an angle substantially different in relation to the centre axis, whereby flow in the direction of the hole bottom may be enhanced. In a third embodiment there are a plurality of flow channels 18, directed mutually in different directions.

In the embodiment of the Figure, the flow channel 17 of the bottom member comprises a circular flow groove 19 which is adapted on a cylindrical inner surface of the bottom member 16 and which circulates in the plane of said inner surface, which is at least substantially perpendicular to the longitudinal centre axis X of the arrangement. The width of said circular flow groove 19, that is, the dimension in the direction of the longitudinal centre axis X of the arrangement, is dimensioned wide enough so that the flushing medium flow channel 4 stays open for the entire duration of the boring work regardless of the movement of the drilling means 8. The hole drilling means 8 move by the impact of the percussion piston in the direction of the centre axis X in the manner shown by the arrow M, and additionally the hole drilling means 8 rotate around the centre axis X.

On both sides of the circular flow groove 19, seals 20 (shown in FIG. 2*a*) are advantageously installed, the purpose of which is the prevent the flushing medium to leak out of the flushing medium channel.

The percussion piston 6 is operated by compressed air which is fed to the cylinder 9 of the percussion hammer from a compressed air flow channel 3. In the embodiment of FIG. 1, the compressed air that operated the percussion piston 6 is removed from the cylinder 9 by an exhaust air channel 21, which comprises a centre opening 22 in the drilling means 8. This is in flow connection to at least one air channel 23 radially passing through the bottom member 16 of the percussion hammer, this channel being in turn in flow connection to the space between the percussion hammer 5 and casing 1. Air exits this space at the top end of the casing 1.

Figure 2A:
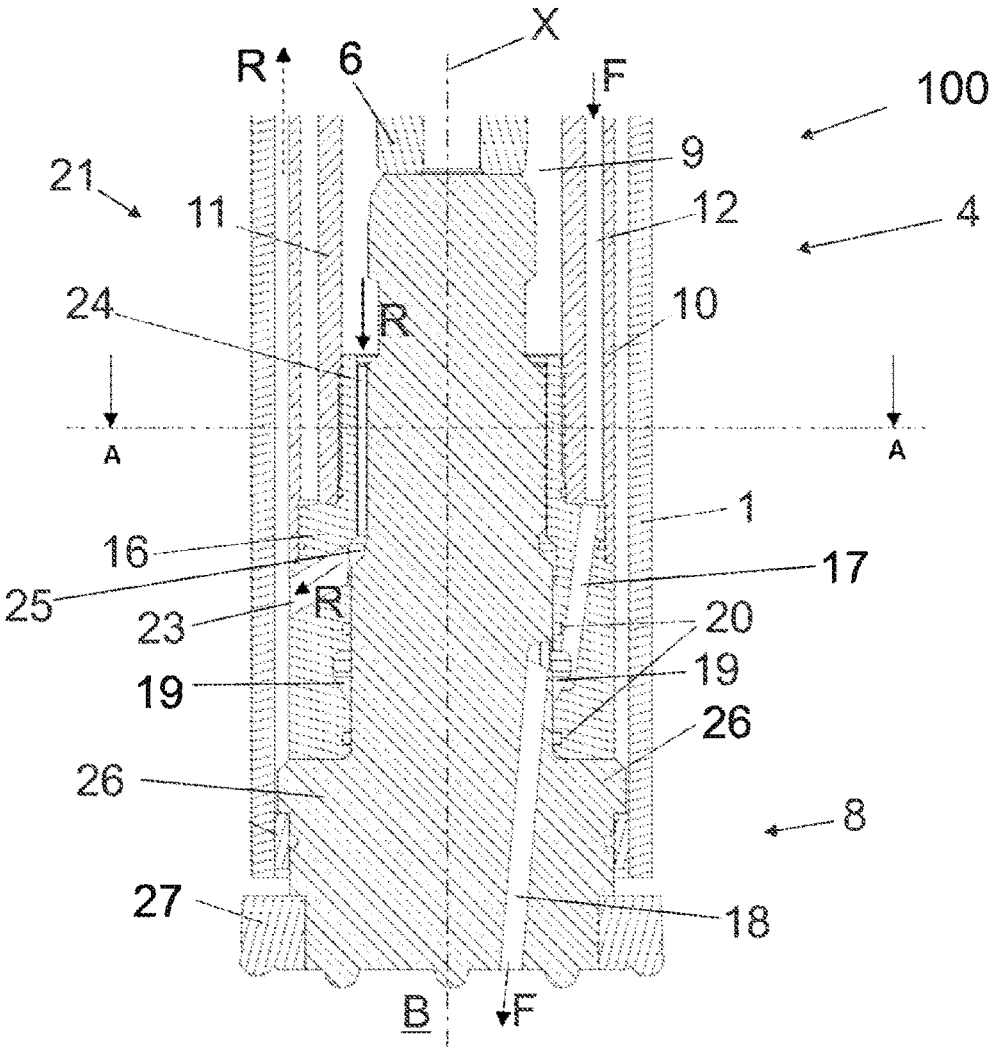
FIG. 2*a* is a schematic sectional side view of a second arrangement for installing a casing.
Figure 2B:
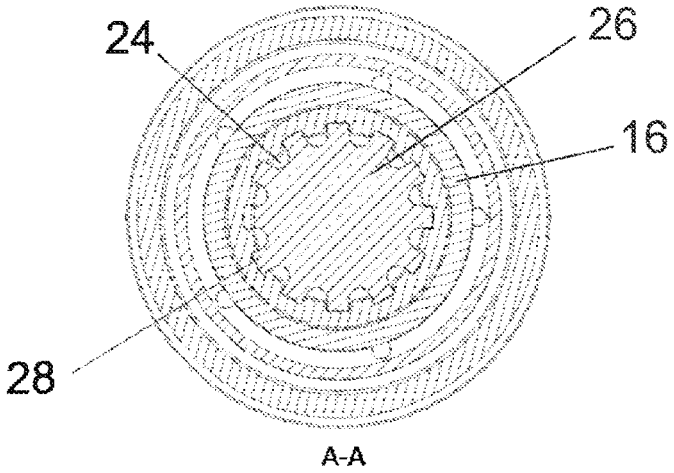
FIG. 2*b* shows a cross section A-A of the arrangement of FIG. 2*a*.

FIG. 2*a* is a schematic sectional side view of a second arrangement for installing a casing, and FIG. 2*b* is its cross section A-A. In this embodiment, the flushing medium flow channel is implemented in the same manner as in the embodiment of FIG. 1. Instead, there is a difference in arranging the removal of compressed air. Now, the compressed air that drove the percussion piston 6 is removed by the exhaust air channel 21 which comprises at least one side exhaust air channel 24, led past the drilling means 8 and being in flow connection to the cylinder 9 of the percussion hammer.

The advantage is that there is no need to drill or otherwise machine channels in the drilling means 8 for the exhaust air, which would reduce its solidity.

FIG. 2*b* shows an embodiment where the side exhaust air channel 24 is formed among splines 28 that transmit a rotating movement to the drilling means 8.

The exhaust air channel 21 further comprises a circular air flow channel 25 which is adapted on the inner surface of the bottom member 16. The circular air flow channel 25 circulates said inner surface in a plane that is at least substantially perpendicular to the longitudinal centre axis X of the arrangement.

The width of said circular flow groove 25, that is, the dimension in the direction of the longitudinal centre axis X of the arrangement, is large enough so that the flow channel 21 stays open for the entire duration of the boring work regardless of the movement of the drilling means 8.

The circular air flow channel 25 is in flow connection to said at least one air exhaust channel 24 and at least one air channel 23 passing through the bottom member 16 of the percussion hammer, this channel being in turn in flow connection to the space between the percussion hammer 5 and casing 1. Air exits said gap in the manner already explained.

Figure 3A:
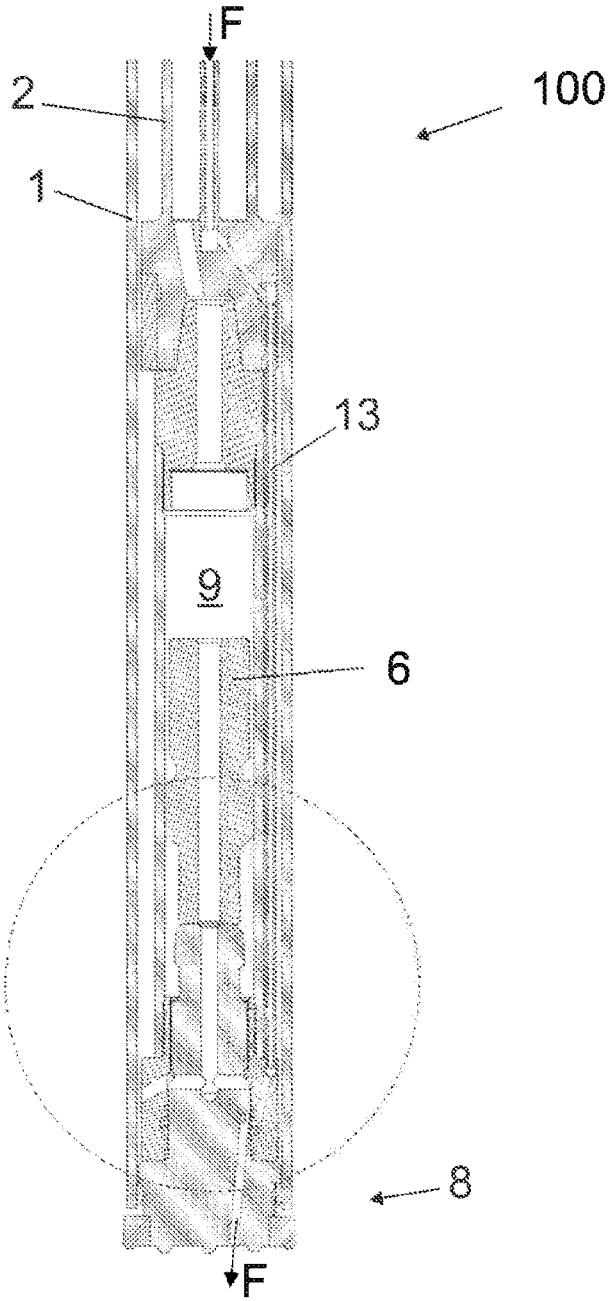
FIG. 3*a* is a schematic sectional side view of a third arrangement for installing a casing.
Figure 3B:
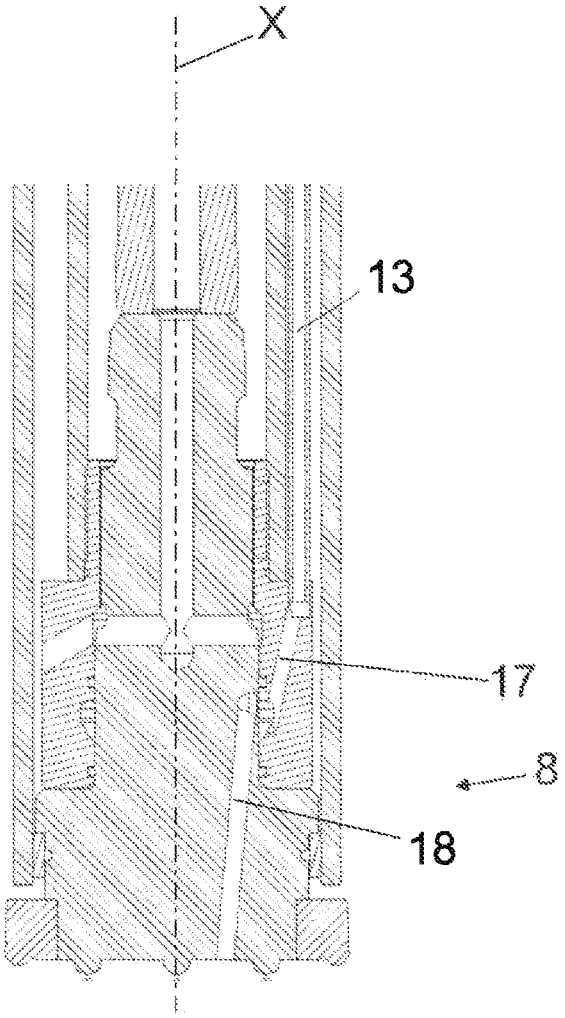
FIG. 3*b* is a schematic sectional side view of a detail of the arrangement of FIG. 3*a*.

FIG. 3*a* is a schematic sectional side view of a second arrangement for installing a casing, and FIG. 3*b* a detail thereof sectionally from the side. According to an idea, the part 12 of the flushing medium flow channel, said part bypassing the percussion piston 6, is formed by using a pipe 13 adapted outside the cylinder 9 of the percussion hammer. In the embodiment of FIG. 3*a*, the is one pipe 13 but there may obviously be more of them.

The advantage is that the flushing medium flow channel 4 may be implemented in a very simple way.

In other respects, the flushing medium flow channel 4 is implemented as in the embodiment of FIG. 1.

The exhaust air channel 21 comprises an air channel 23 formed in the drilling means 8, and a channel leading from it to the bottom member 16 and further through the bottom member.

Figure 4A:
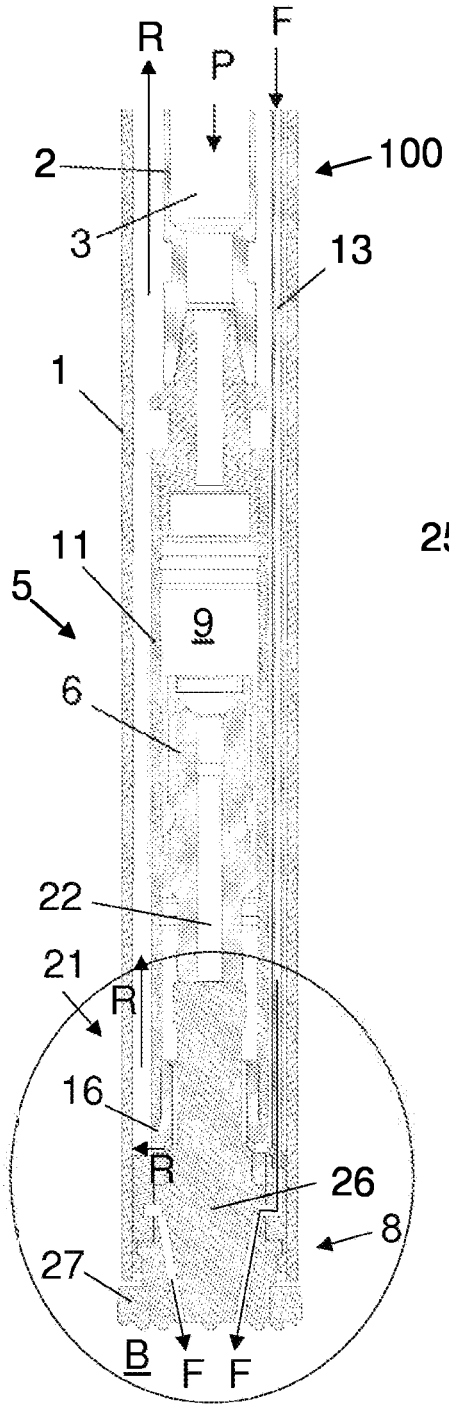
FIG. 4*a* is a schematic sectional side view of an arrangement for installing a casing.
Figure 4B:
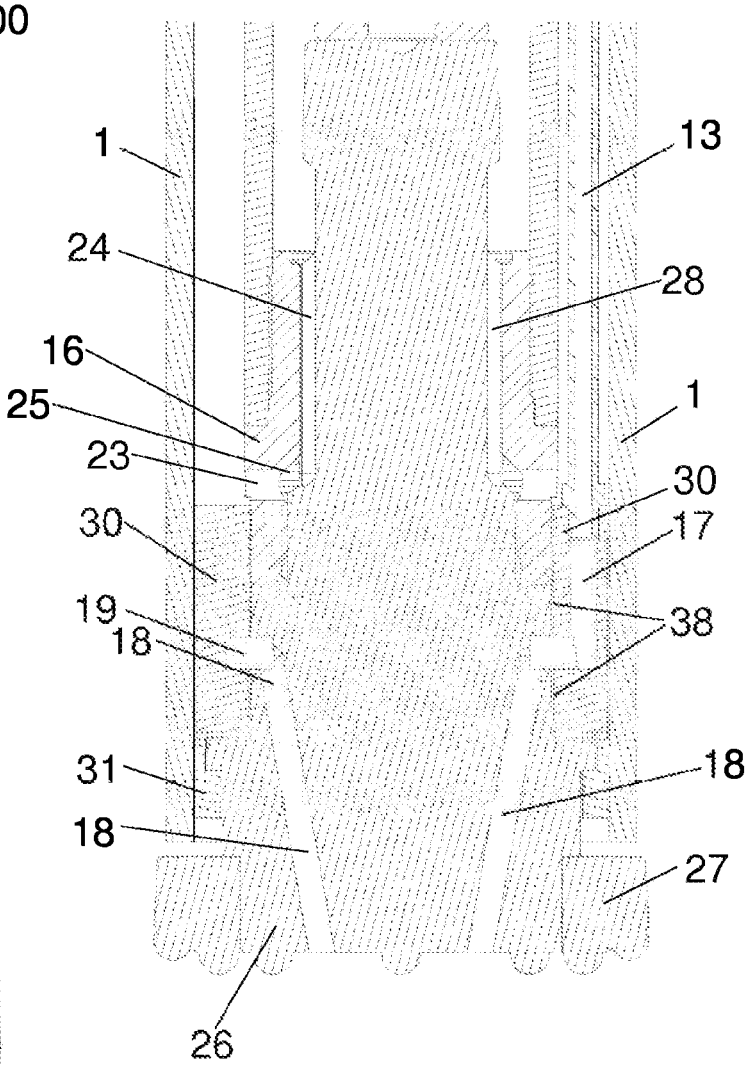
FIG. 4*b* is a schematic sectional side view of a detail of the arrangement of FIG. 4*a*, FIGS. 5*a* to 5*c* are sectional side views of alternative details of a collar of the arrangement of FIGS. 4*a* and 4*b*.

FIG. 4*a* is a schematic sectional side view of an arrangement for installing a casing, and FIG. 4*b* a detail thereof sectionally from the side. In this embodiment, the flushing medium flow channel 4 may be implemented by a part 12 of the flow channel, as in FIG. 3*a*, this part advantageously being a pipe 13 or a hose. In FIG. 3*a*, the pipe 13 is connected by its top end to an adaptor 14 of the boring pipe, whereby it rotates with the boring pipe 2. In the embodiments of FIGS. 4*a* and 4*b*, the pipe 13 may be connected by its bottom end to at least one collar 30, which is advantageously circular, whereby the pipe 13 cannot rotate with the boring pipe 2. The collar 30 may be connected or fastened to the casing 1 or a drill shoe 31 connected to the casing 1 by means of at least one locking part 32 such as a sleeve. The fastening or locking of the collar 30 may also be implemented by means of locking parts 32 set symmetrically. The locking part 32 may be formed of rubber or another suitable flexible material. The pipe 13 may be fastened to the casing 1 in a fixed and non-rotating manner, whereby it will not rotate with the boring pipe 2. By means of the locking part 32, the collar 30 may be both locked and sealed to the casing 1, whereby it is possible to lead all the flushing medium to the bottom B of the borehole. The arrangement 100 may further comprises one or more seals 38 to prevent water from getting to other structures.

By using a solution where the flushing medium is led past the percussion piston 6 by a non-rotating pipe 13 considerable savings are achieved, because a standard percussion hammer 5 and boring pipe 2 may be used instead of purpose-built ones. In addition, the flushing medium may be supplied by means of a normal pipe 13 and pump. The pipe 13 may also be used, once boring is complete, to inject the cement slurry to the bottom B of the drilled hole to strengthen the drilled hole.

In the embodiments according to FIGS. 4*a* and 4*b*, the removal of compressed air may be arranged like in the embodiment shown in FIG. 2*a*. The percussion piston 6 is operated by compressed air which is fed to the cylinder 9 of the percussion hammer from a compressed air flow channel 3. The compressed air that drove the percussion piston 6 is removed by the exhaust air channel 21 which comprises at least one side exhaust air channel 24, led past the drilling means 8 and being in flow connection to the cylinder 9 of the percussion hammer. The exhaust air channel 21 comprises a circular air flow channel 25 which is adapted on the inner surface of the bottom member 16. The circular air flow channel 25 is in flow connection to said at least one side air exhaust channel 24 and at least one air channel 23 passing through the bottom member 16 of the percussion hammer, this channel being in turn in flow connection to the space between the percussion hammer 5 and casing 1, from which the air exists at the top end of the pipe.

In embodiment according to FIGS. 4*a* and 4*b*, the removal of compressed air may also be arranged so that the side exhaust air channel 24 is formed among splines 28 that transmit a rotating motion to the drilling means 8, as was described in the embodiment of FIG. 2*b*.

Figure 5A:
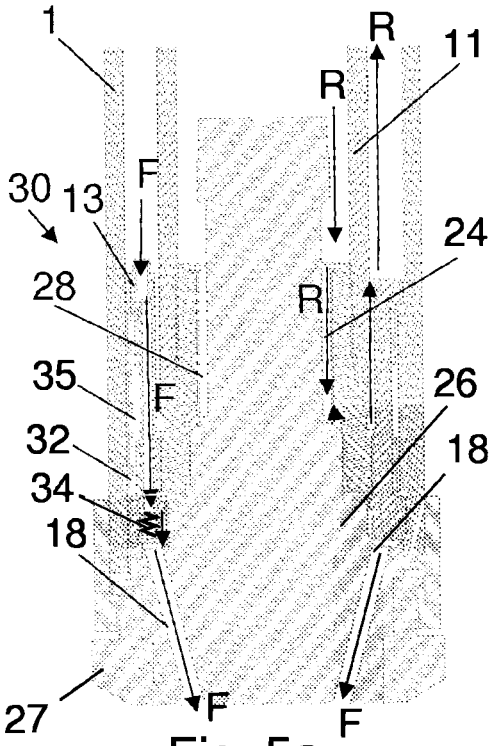
Figure 5B:
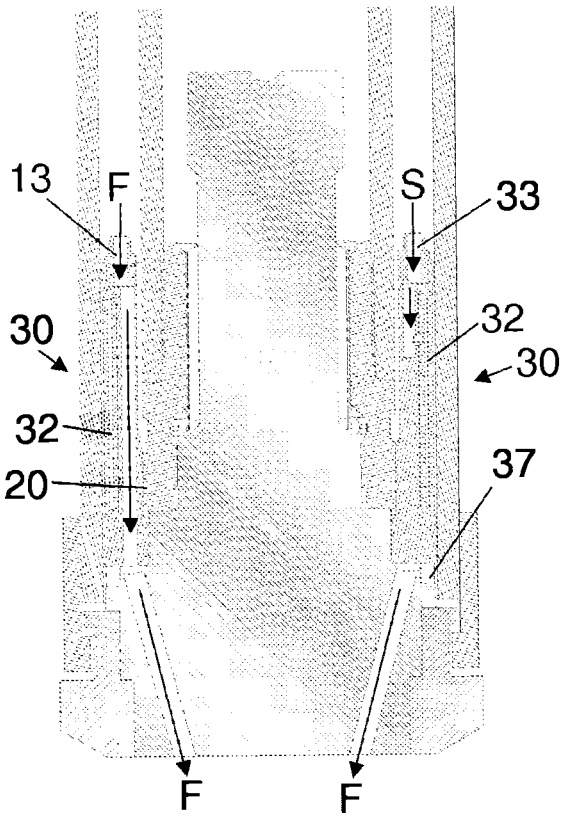
Figure 5C:
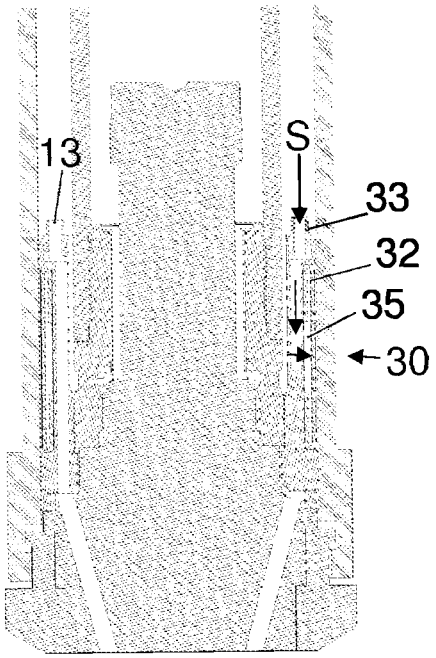

FIGS. 5*a* to 5*c* are sectional side views of alternative details of a collar 30 of the arrangement of FIGS. 4*a* and 4*b*. For reasons of clarity, FIGS. 5*a* to 5*c* do not show the exhaust air channel 21, which may be according to the details shown in FIGS. 4*a* and 4*b*. In the embodiment of FIG. 5*a*, the collar 30 may comprise a locking part 32. The collar 30 and locking part 30 may be circular and circulate on the inner surface of the casing 1. The collar 30 connects to the casing 1 or casing shoe 31 connected to the casing. The locking part 32 may be located on the outer surface of the collar 30 against the casing 1, fastening and sealing the collar 30 and preventing its rotation with the pilot crown 26. At least one locking part 32 may be adapted to lock at least one collar 30 to the casing 1 or casing shoe 31 by means of a pressurised flushing medium. The locking part 32 may comprise an open inner part 35, as shown in FIG. 5*a*, or the inner part may be solid. An open inner part 35 allows the flushing medium to access the inside of the locking part 32. Manufacturing a locking part 32 having an open inner part 35 is easier and more economical. By means of a pressure limit valve 34, the pressure of the flushing medium may be raised to be adequate, and to lock the collar 30 to the casing 1 in a non-rotating fashion. The pressure is advantageously 4 bar. As in FIG. 5*a*, the pressurised flushing medium may be led from the pipe 13 to the locking part 30 where the locking part 32 is pressurised against the casing. According to an embodiment, the removal of compressed air may be arranged through the splines 28 transmitting a rotating motion. The run of the flushing medium is shown by the arrows F and the removal of compressed air by the arrows R.

According to an embodiment shown in FIG. 5*b*, the locking and sealing of the collar 30 may be performed by means of the locking part 32, in which the pressurisation may be carried out on a separate pressure line 33 of the locking part. The pressurised substance is brought in according to the arrow S through the pressure line 33 to lock and seal the collar 30 against the casing 1. By means of the seal 20, a leakage gap between the collar 30 and pilot crown 26 may be sealed and the access of water inside the casing prevented. In the embodiment of FIG. 5*b*, the locking part 32 comprised a closed inner part. FIG. 5*c* shown an arrangement according to FIG. 5*b*, where the locking part 32 comprises an open inner part 35.

Figure 6:
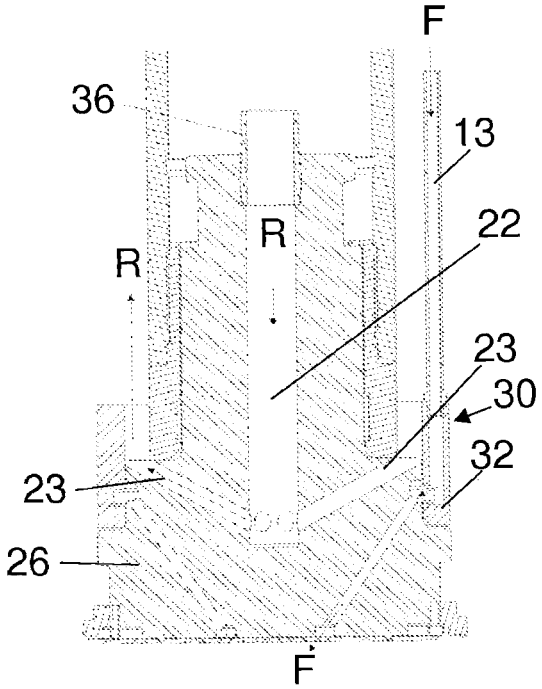
FIG. 6 is a schematic sectional side view of a detail of an arrangement.

FIG. 6 is a schematic sectional side view of a detail of an arrangement. To simplify the Figure, there is no casing 1 or casing shoe 31 shown. In accordance with FIGS. 4*a* and 4*b*, the flushing medium is brought along the pipe 13 to the collar 30 which is locked non-rotatable to the casing 1 or casing shoe 31. In the arrangement, the percussion hammer 5 comprises a pilot crown 26 with a foot valve 36 or without a foot valve. Pressurised exhaust air R may be brought through a centre opening 22 arranged through the pilot crown 26, and removed through at least one air channel 23 to the space between the percussion hammer 5 and casing 1.

Figure 8:
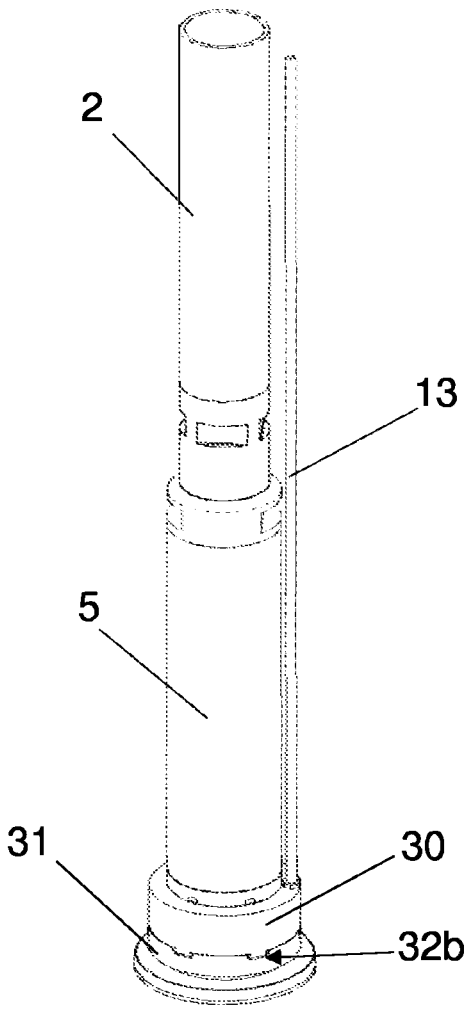
FIG. 8 is a side view of a detail of collar of an arrangement.

FIG. 8 is a side view of a detail of the collar 30 of an arrangement. FIG. 8 describes an arrangement similar to the one in FIGS. 5*a* to 5*b*, but the locking of the collar 30 is arranged in an alternative manner. The pipe 13 may be connected by its bottom end to at least one collar 30. The collar 30 may be connected or fastened to the casing 1 or a casing shoe 31 connected to the casing 1 by means of at least one locking part 32*b*. The locking part 32*b* may comprise a mechanical locking, such as a gearing of FIG. 8, between the casing shoe 31 and collar 30. According to an embodiment, the locking part 32*b* may comprise, on the inner surface of the casing 1 or casing shoe 30, at least one rib, protrusion, or pin fixed by welding, for example. It is similarly possible to form at least one groove on the outer surface of the collar 30 to lock the collar 30 in a non-rotating manner to the rib, protrusion, or pin of the casing 1 or casing shoe 31. The fastening or locking of the collar 30 may also be implemented by means of locking parts 32*b* set symmetrically.

Figure 7A:
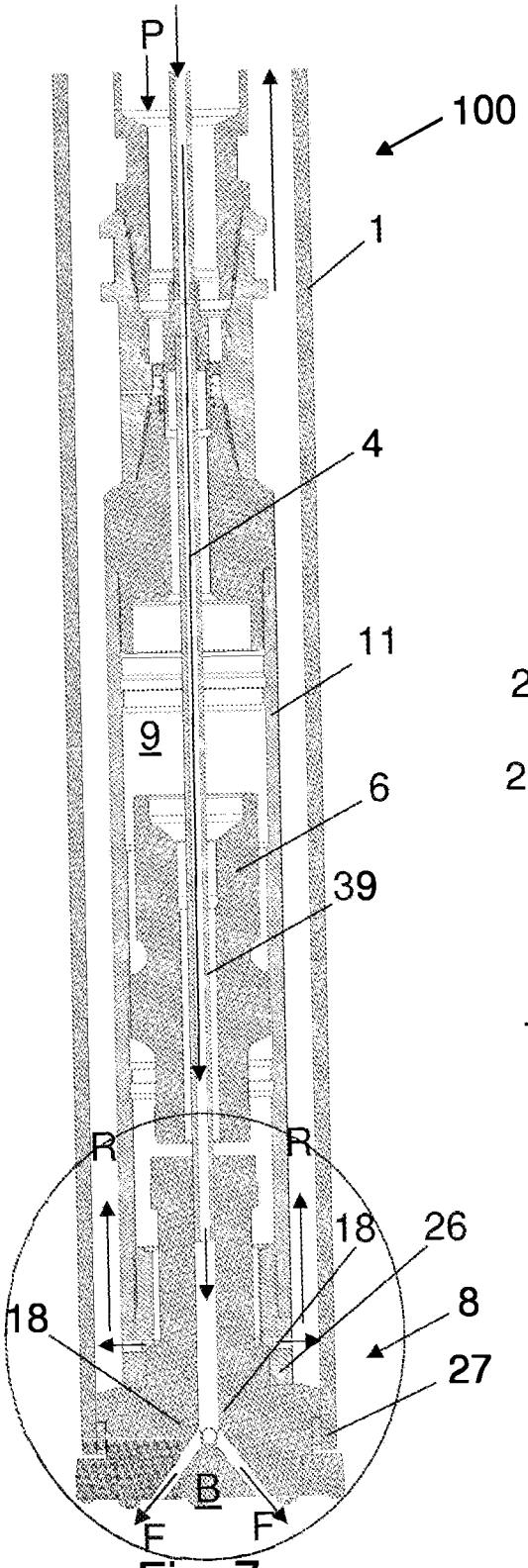
FIG. 7*a* is a schematic sectional side view of an arrangement for installing a casing.
Figure 7B:
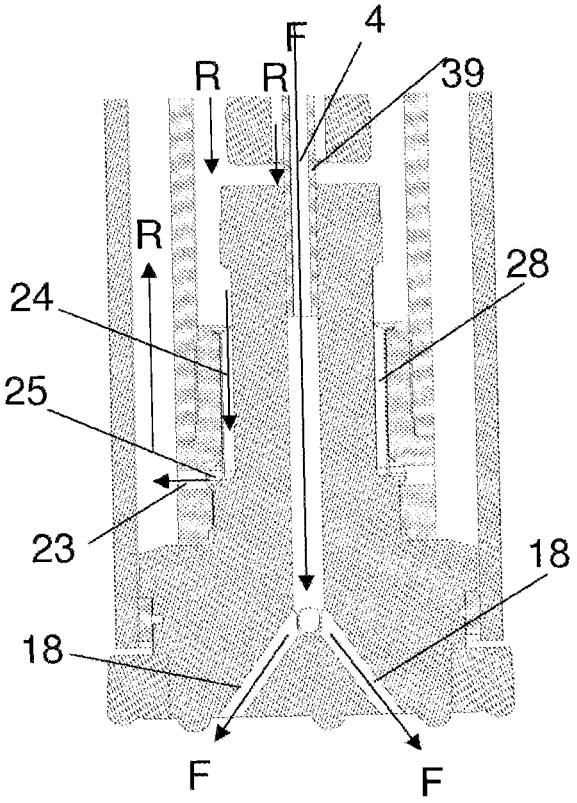
FIG. 7*b* is a schematic sectional side view of a detail of the arrangement of FIG. 7*a*.

FIG. 7*a* is a schematic sectional side view of an arrangement for installing a casing. FIG. 7*b* is a schematic sectional side view of a detail of the arrangement of FIG. 7*a*. Differing from FIGS. 1 to 6, the bottom B of the borehole may be flushed by a flushing medium which is led through the percussion piston 6 to the hole drilling means 8 along a flushing medium pipe 39 in the centre opening 22 and further to the bottom B of the borehole along a flushing medium flow channel 18 of the drilling means. In embodiments according to FIGS. 7*a* and 7*b*, the removal of compressed air may be arranged through the side exhaust air channel 24, according to FIG. 2*a*. In an embodiment, the side exhaust air channel 24 is formed among splines 28 that transmit a rotating motion to the drilling means 8, as was described in the embodiments of FIGS. 2*b*, 4*a*, 4*b*, 5*a* to 5*b*.

The arrangement 100 may be used according to, for example, the following method:

rotating the boring pipe 2 inside the casing 1, driving the percussion hammer 5 by compressed air, and removing released material by flushing the bottom B of the borehole by a flushing medium which is led past the percussion piston 6 of the percussion hammer from the borehole 2 to the hole drilling means 8 and further to the bottom B of the borehole, or by flushing the bottom B of the borehole by a flushing medium which is led through the percussion piston 6 to the hole drilling means 8 and further to the bottom B of the borehole, and the drilling means 8 in the arrangement additionally comprising splines 28 transmitting a rotating motion and by means of which the compressed air that drove the percussion piston 6 is led through the splines 28.

In some cases, features disclosed in this application may be used as such, regardless of other features. On the other hand, when necessary, features disclosed in this application may be combined in order to provide different combinations.

The drawings and related disclosure are only intended to illustrate the inventive idea. It is apparent to a person skilled in the art that the invention is not restricted to the embodiments described above, in which the invention is disclosed through some examples, but various modifications and different applications of the invention are feasible within the inventive idea defined in the accompanying claims.

REFERENCE MARKINGS

1 casing
2 boring pipe
3 compressed air flow channel
4 flushing medium flow channel
5 percussion hammer
6 percussion piston
8 hole drilling means
9 percussion hammer cylinder
10 shell
11 cylinder wall
12 part of flow channel
13 pipe
14 boring pipe adaptor
15 adaptor flow channel
16 bottom member of percussion hammer
17 bottom member flushing medium flow channel
18 drilling means flushing medium flow channel
19 circular flow groove
20 seal
21 exhaust air channel
22 centre opening
23 air channel
24 side exhaust air channel
25 circular air flow channel
26 pilot crown
27 reamer
28 spline
30 collar
31 casing shoe
32, 32*b* locking part
33 pressure line
34 pressure limit valve
35 open inner part
36 distributing valve
37 damper
38 seal
39 flushing medium pipe
100 arrangement
B bottom of borehole
F flushing medium
P compressed air
R exhaust air
X longitudinal centre axis of arrangement

What is claimed is:

1. An arrangement for installing a casing in a borehole, the arrangement comprising:

a casing;

a boring pipe which is adapted within the casing, the boring pipe comprising a flow channel for compressed air;

a flushing medium flow channel arranged within the casing and arranged to lead the flushing medium to the bottom of the borehole, the casing being installed in the borehole permanently;

a percussion hammer which comprises a compressed air operated percussion piston adapted in a cylinder of the percussion hammer;

hole drilling means for drilling a hole for the casing; and guiding means for guiding exhaust air of the compressed air to a space between the percussion hammer and the casing, the flushing medium flow channel being adapted to bypass the percussion piston by leading the flushing medium around an outside of the percussion piston, or in which arrangement the drilling means additionally comprises splines transmitting a rotating motion and adapted to conduct the compressed air that operated the percussion piston through the splines, and in which arrangement the flushing medium flow channel is adapted to pass through the percussion piston.

2. An arrangement as claimed in claim 1, wherein, on the outside of the cylinder of the percussion hammer, there is adapted a shell, which together with an outer wall of the cylinder, forms part of the flushing medium flow channel, bypassing the percussion piston.

3. An arrangement as claimed in claim 2, wherein the part of the flushing medium flow channel, which part bypasses the percussion piston, extends circularly around the cylinder of the percussion hammer.

4. An arrangement as claimed in claim 2, where the shell adapted on the outside of the cylinder forms part of the outer surface of the percussion hammer.

5. An arrangement as claimed in claim 1, wherein, on the outside of the cylinder of the percussion hammer, there are adapted one or more pipes which form part of the flushing medium flow channel, bypassing the percussion piston.

6. An arrangement as claimed in claim 5, wherein the part of the flushing medium flow channel, which bypasses the percussion piston is at its top end connected to an adaptor of the boring pipe, having an adapter flow channel which is arranged to move the flushing medium flow channel further from a longitudinal center axis of the arrangement.

7. An arrangement as claimed in claim 5, wherein the arrangement further comprises at least one collar which is connected to the casing or to a casing shoe fixed to the casing, where the part of the flushing medium flow channel, bypassing the percussion piston, is by its bottom end connected to at least one collar.

8. An arrangement as claimed in claim 7 wherein at least one collar additionally comprises at least one locking member for locking the at least one collar to the casing or casing shoe.

9. An arrangement as claimed in claim 8, wherein at least one locking part is adapted to lock at least one collar to the casing or casing shoe by means of a pressurized flushing medium.

10. An arrangement as claimed in claim 8, wherein the at least one locking part comprises a pressure line which is adapted to lock the at least one collar to the casing or casing shoe.

11. An arrangement as claimed in claim 5, wherein the percussion hammer comprises a bottom member which has at least one flushing medium flow channel of the bottom member, which is adapted in flow connection to the part of the flushing medium flow channel, bypassing the percussion piston, and in which the hole drilling means comprises at least one flushing medium flow channel of the drilling means, which is adapted in flow connection to the flushing medium flow channel of the bottom member and to lead the flushing medium to the bottom of the borehole.

12. An arrangement as claimed in claim 11, wherein the flow channel of the bottom member comprises a circular flow groove which is adapted on the inner surface of the bottom member and which circulates in the plane of said inner surface which is at least substantially perpendicular to the longitudinal center axis of the arrangement.

13. An arrangement as claimed in claim 12, further comprising seals adapted on both sides of the circular flow groove.

14. An arrangement as claimed in claim 1, wherein the hole drilling means comprises at least one flushing medium flow channel of the drilling means, which is adapted to lead the flushing medium from the flushing medium flow channel to the bottom of the borehole, and in which arrangement the flushing medium flow channel is adapted to pass through the percussion piston.

15. An arrangement as claimed in claim 1, wherein the compressed air that operated the percussion piston is removed by an exhaust air channel that comprises a center opening in the hole drilling means, which is in flow connection to the cylinder of the percussion hammer, and at least one air channel passing radially from the center opening through a bottom member of the percussion hammer, the air channel being in flow connection to the space between the percussion hammer and casing.

16. An arrangement as claimed in claim 1, wherein the drilling means additionally comprises splines transmitting a rotating motion and adapted to conduct the compressed air that operated the percussion piston through the splines.

17. An arrangement as claimed in claim 1, wherein the compressed air that drove the percussion piston is removed by the exhaust air channel, the arrangement further comprising:

at least one side exhaust air channel led past the hole drilling means, which is in flow connection to the cylinder of the percussion hammer;

an air flow channel which is in flow connection to said at least one exhaust air channel; and at least one air channel passing radially from the air flow channel through the bottom member of the percussion hammer, this channel being in flow connection to the space between the percussion hammer and casing.

18. An arrangement as claimed in claim 17, wherein the side exhaust air channel is formed among the splines.

19. An arrangement as claimed in claim 17, wherein the circular air flow channel is adapted on the inner surface of the bottom member, is adapted against the drilling means, and circulates said part of the drilling means in a plane that is at least substantially perpendicular to the longitudinal center axis of the arrangement.

20. A method for installing a casing, the method utilizing an arrangement that comprises a casing and boring pipe, a percussion hammer and means for boring a hole, the method comprising:

rotating the boring pipe inside the casing, the boring pipe comprising a flow channel for compressed air, a flushing medium flow channel arranged within the casing and arranged to lead a flushing medium to the bottom of the borehole, the casing being installed in the borehole permanently; driving the percussion hammer by the compressed air, the percussion hammer comprising a compressed air operated percussion piston adapted in a cylinder of the percussion hammer; and flushing the bottom of the borehole using the flushing medium flow channel which is adapted to bypass the percussion piston by leading the flushing medium around an outside of the percussion piston, or flushing the bottom of the borehole by the flushing medium which is led through the percussion piston to the hole drilling means and further to the bottom of the borehole, in which arrangement the drilling means additionally comprises splines which transmit a rotation motion and by means of which the compressed air that operated the percussion piston is led through the splines.

21. An arrangement for installing a casing in a borehole, the arrangement comprising:

a casing;

a boring pipe which is adapted within the casing, the boring pipe comprising a flow channel for compressed air;

a flushing medium flow channel arranged within the casing and arranged to lead the flushing medium to the bottom of the borehole;

a percussion hammer which comprises a compressed air operated percussion piston adapted in a cylinder of the percussion hammer; and hole drilling means for drilling a hole for the casing, wherein, on the outside of the cylinder of the percussion hammer, there is adapted a shell, which together with an outer wall of the cylinder, forms part of the flushing medium flow channel, bypassing the percussion piston, the flushing medium flow channel being adapted to bypass the percussion piston, or in which arrangement the drilling means additionally comprises splines transmitting a rotating motion and adapted to conduct the compressed air that operated the percussion piston through the splines, and in which arrangement the flushing medium flow channel is adapted to pass through the percussion piston.

22. An arrangement for installing a casing in a borehole, the arrangement comprising:

a casing;

a boring pipe which is adapted within the casing, the boring pipe comprising a flow channel for compressed air;

a flushing medium flow channel arranged within the casing and arranged to lead the flushing medium to the bottom of the borehole;

a percussion hammer which comprises a compressed air operated percussion piston adapted in a cylinder of the percussion hammer; and hole drilling means for drilling a hole for the casing, wherein the compressed air that operated the percussion piston is removed by an exhaust air channel that comprises a center opening in the hole drilling means, which is in flow connection to the cylinder of the percussion hammer, and at least one air channel passing radially from the center opening through a bottom member of the percussion hammer, the air channel being in flow connection to the space between the percussion hammer and casing, the flushing medium flow channel being adapted to bypass the percussion piston, or in which arrangement the drilling means additionally comprises splines transmitting a rotating motion and adapted to conduct the compressed air that operated the percussion piston through the splines, and in which arrangement the flushing medium flow channel is adapted to pass through the percussion piston.

23. An arrangement for installing a casing in a borehole, the arrangement comprising:

a casing;

a boring pipe which is adapted within the casing, the boring pipe comprising a flow channel for compressed air;

a flushing medium flow channel arranged within the casing and arranged to lead the flushing medium to the bottom of the borehole;

a percussion hammer which comprises a compressed air operated percussion piston adapted in a cylinder of the percussion hammer;

hole drilling means for drilling a hole for the casing, wherein the compressed air that drove the percussion piston is removed by the exhaust air channel;

at least one side exhaust air channel led past the hole drilling means, which is in flow connection to the cylinder of the percussion hammer;

an air flow channel which is in flow connection to said at least one exhaust air channel; and at least one air channel passing radially from the air flow channel through the bottom member of the percussion hammer, the at least one air channel being in flow connection to the space between the percussion hammer and casing, the flushing medium flow channel being adapted to bypass the percussion piston, or in which arrangement the drilling means additionally comprises splines transmitting a rotating motion and adapted to conduct the compressed air that operated the percussion piston through the splines, and in which arrangement the flushing medium flow channel is adapted to pass through the percussion piston.

* * * * *